US008162396B2

(12) United States Patent
Edwards

(10) Patent No.: US 8,162,396 B2
(45) Date of Patent: Apr. 24, 2012

(54) MODULAR, MULTIPLE-SEAT CHAIR

(76) Inventor: Michelle M. Edwards, Ponte Vedra Beach, FL (US)

( * ) Notice: Subject to any disclaimer, the term of this patent is extended or adjusted under 35 U.S.C. 154(b) by 9 days.

(21) Appl. No.: 12/656,846

(22) Filed: Feb. 17, 2010

(65) Prior Publication Data

US 2010/0327642 A1 Dec. 30, 2010

Related U.S. Application Data

(60) Provisional application No. 61/207,930, filed on Feb. 18, 2009.

(51) Int. Cl.
*A47C 7/02* (2006.01)
*A47C 7/62* (2006.01)

(52) U.S. Cl. ..... 297/233; 297/232; 297/234; 297/236; 297/248; 297/188.08; 297/440.22

(58) Field of Classification Search ..... 297/232, 297/233, 234, 236, 237, 248, 188.08, 235, 297/440.22
See application file for complete search history.

(56) References Cited

U.S. PATENT DOCUMENTS 151,411 A 5/1874 Marshall
324,661 A 8/1885 Crandall
388,191 A * 8/1888 Furl et al. ..... 297/236 X
455,933 A * 7/1891 Timmons ..... 297/233
552,323 A * 12/1895 Langhorne ..... 297/236 X
578,056 A * 3/1897 Gautrau ..... 297/236
588,932 A * 8/1897 Stanton ..... 297/236
758,782 A * 5/1904 Ruethin ..... 297/236 X
779,718 A * 1/1905 Kline ..... 297/236
1,114,801 A * 10/1914 Peterson ..... 297/233
1,335,973 A 4/1920 Kesselman
1,369,543 A * 2/1921 Reider ..... 297/234
1,530,420 A * 3/1925 Schmitt ..... 297/233 X
2,116,366 A * 5/1938 Scott ..... 297/234 X
2,187,689 A * 1/1940 Jaray et al. ..... 297/233
2,696,246 A * 12/1954 Putnam ..... 297/232 X
2,699,202 A * 1/1955 Leary et al. ..... 297/233
3,024,066 A * 3/1962 Anderson et al. ..... 297/248
3,093,410 A * 6/1963 Wilson ..... 297/232 X
3,528,096 A * 9/1970 Moberg ..... 297/232 X
3,635,521 A * 1/1972 Shivvers ..... 297/248 X
3,638,997 A * 2/1972 Shapiro et al. ..... 297/232
3,826,206 A * 7/1974 Ruggles ..... 297/248 X
4,438,603 A * 3/1984 Durkan, Jr. ..... 297/232 X
4,657,302 A * 4/1987 Snyder ..... 297/232
6,135,545 A * 10/2000 Liao ..... 297/233 X
6,773,059 B2 * 8/2004 Volotsenko ..... 297/233 X
7,578,551 B2 * 8/2009 Linero ..... 297/234 X

* cited by examiner

*Primary Examiner* — Rodney B White
(74) *Attorney, Agent, or Firm* — Richard C. Litman

(57) ABSTRACT

A modular, multiple-seat chair includes a main chair having a primary seat and a back. The main chair is adapted to support a single person thereon. Secondary seats are conveniently stowed beneath the primary seat and are removable therefrom to provide additional seating when desired. Each secondary seat incorporates a foldable leg and has structure for removably attaching each secondary seat to the primary seat.

10 Claims, 3 Drawing Sheets

MODULAR, MULTIPLE-SEAT CHAIR

CROSS-REFERENCE TO RELATED APPLICATION

This application claims the benefit of U.S. Provisional Patent Application Ser. No. 61/207,930, filed Feb. 18, 2009.

BACKGROUND OF THE INVENTION

1. Field of the Invention

The present invention generally relates to chairs, and particularly to a modular, multiple-seat chair that provides a chair assembly convertible from use by a single person to use by more than one person.

2. Description of the Related Art

Often when one is seated and working on a particular project that requires focusing on a centralized object such as a computer screen or the like, the need arises to enlist one or more additional sets of eyes to insure that the project is proceeding correctly. This scenario usually requires that the additional people stand or stoop beside the person seated in the chair. Alternatively, extra chairs (if available) must be laboriously transported from surrounding areas so that the additional people can be comfortably seated. Both of the above-described scenarios involve either discomfort or disruption. It would certainly be advantageous if additional seating were already easily available and incorporated in the primary chair. The related art discloses such arrangements but the disclosed devices are inefficient and cumbersome. The art would certainly welcome a chair that is of a relatively modern design and is easily converted from a single to multiple seating arrangements with a minimum of difficulty. Thus, a modular, multiple-seat chair solving the aforementioned problems is desired.

SUMMARY OF THE INVENTION

The modular, multiple-seat chair includes a main chair having a primary seat and a back. Arms may or may not be provided for the main chair as desired. The main chair is adapted to support a single person thereon. Secondary seats are conveniently stowed beneath the primary seat and are removable therefrom to provide additional seating when desired. Each secondary seat incorporates a foldable outboard leg and is also adapted for removable attachment to the frame of the primary seat, being supported partially by the outboard leg and partially by the primary seat.

Accordingly, the invention presents a chair that can be efficiently converted from use by a single person to use by more than one person. The chair is of modular design and easy to use. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
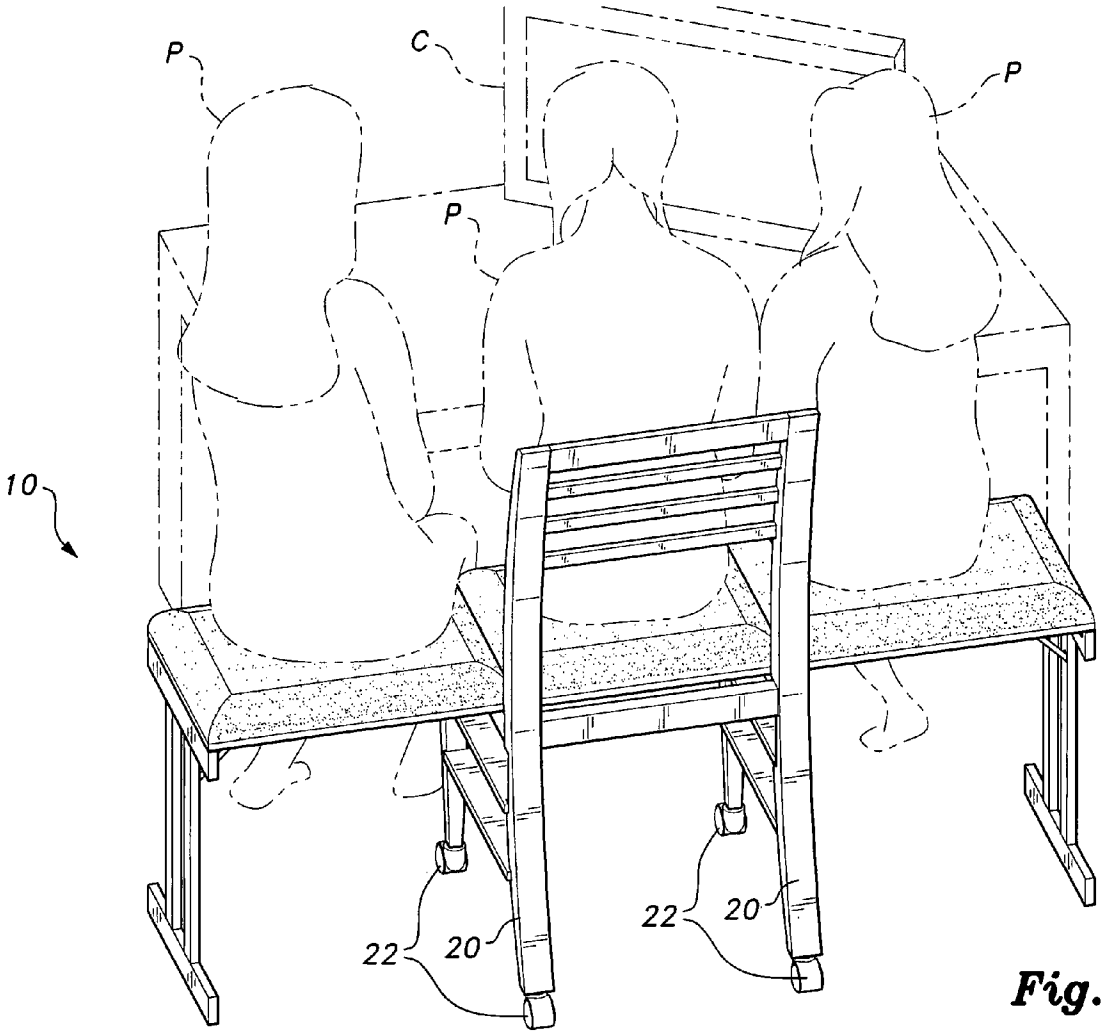
FIG. 1 is an environmental, perspective view of a modular, multiple-seat chair according to the present invention.
Figure 2:
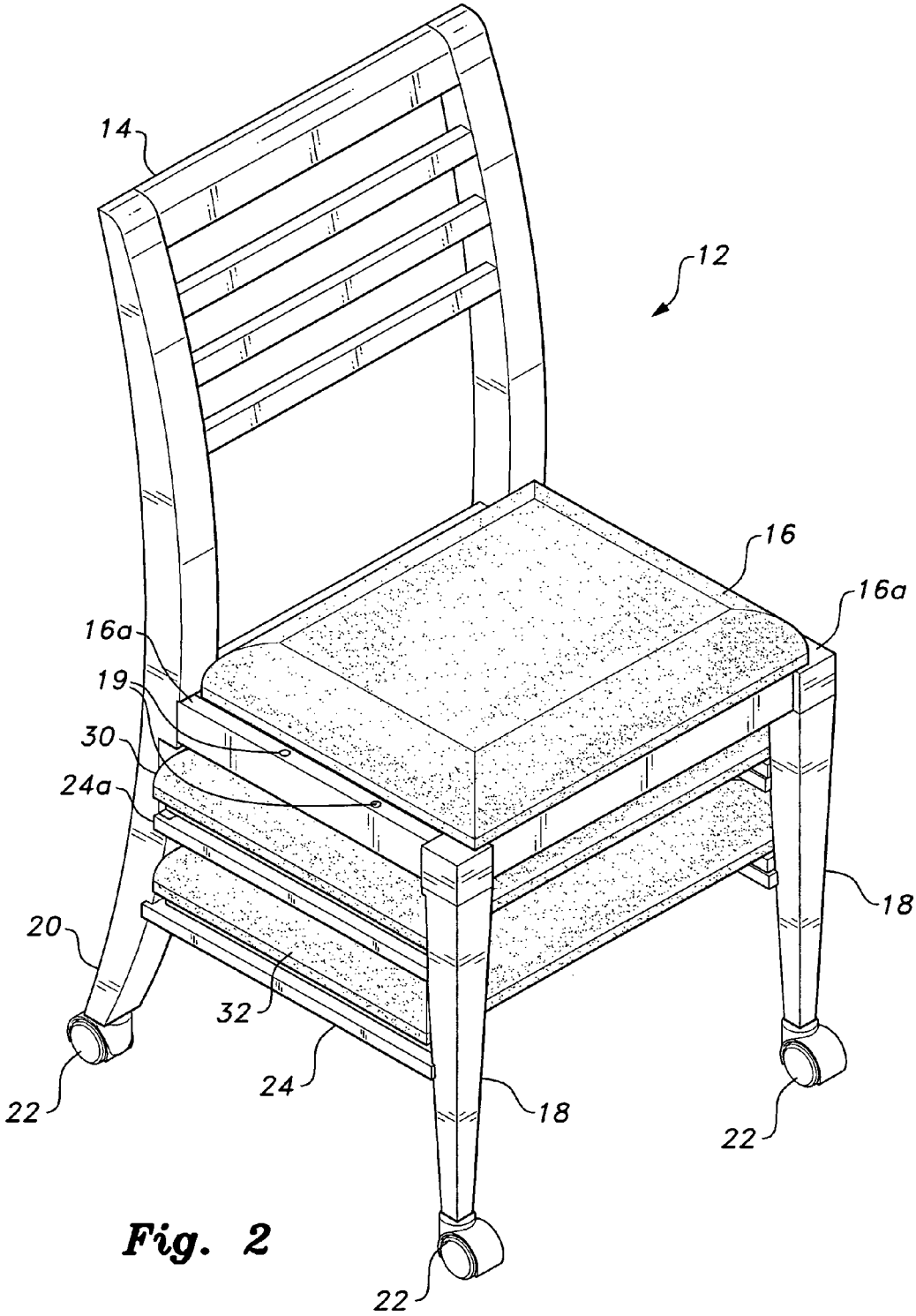
FIG. 2 is a perspective view of a modular, multiple-seat chair according to the present invention, shown with the secondary seats in stowed positions.
Figure 3:
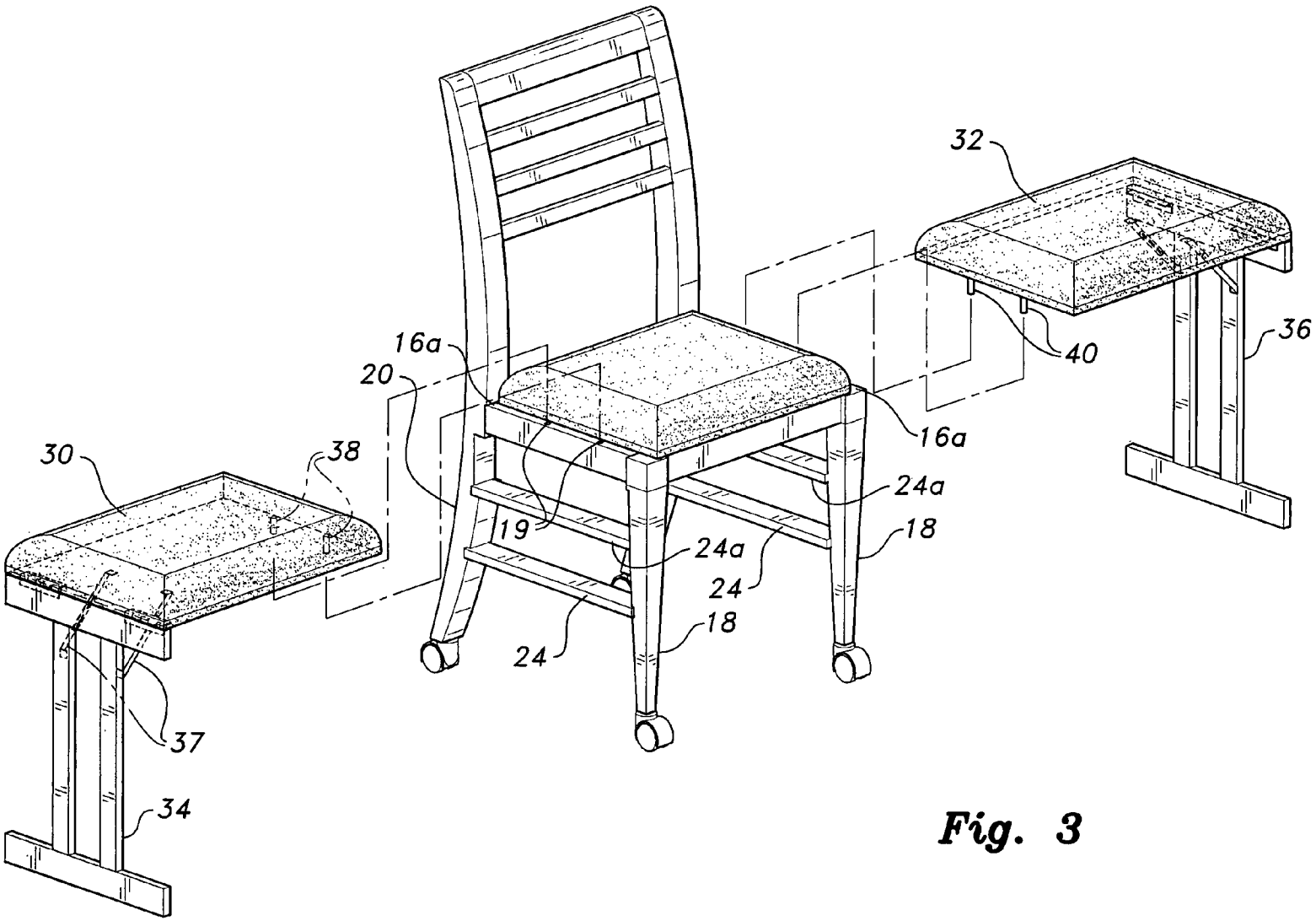
FIG. 3 is an exploded, perspective view of a modular, multiple-seat chair according to the present invention.

Referring to FIGS. 1-3, the modular, multiple-seat chair 10 is designed to support multiple people P for congregation around a central object of focus C. As best seen in FIGS. 2 and 3, the modular chair 10 comprises a main chair, generally indicated at 12. Main chair 12 incorporates a frame having a back 14, a primary seat 16 and respective pairs of front and rear legs 18, 20. The lower ends of the front and rear legs 18, 20 are provided with wheels or rollers 22 so that the main chair can be easily moved. Rails or support structures 24, **24*a*, whose purpose will be explained below, span the distance between each respective pair of front legs 18 and rear legs 20. The primary seat 16 includes ledges 16*a* positioned on each side thereof. Each ledge includes a pair of spaced holes 19** or blind bores (only one side shown, the other side being symmetric) formed therein.

Two secondary seats 30 and 32 are removably stowed beneath the primary seat 16 and are supported on support structure 24, **24*a*. Each secondary seat has a respective foldable leg 34, 36 attached to the respective seat's undersurface at respective first ends thereof. Each leg includes collapsible braces 37. Each secondary seat has respective dowels or pegs 38, 40 depending from the undersurface of each seat at respective second ends thereof. Pegs 38, 40 are designed and dimensioned for removable insertion in holes 19**. Both primary and secondary seats are provided with cushioned seating surfaces. The main chair and seats can be fabricated from any suitable, durable material or combinations thereof (wood, metal, plastic, etc). Lightweight materials are preferred. Other conventional types of attachment means (tongue and groove, nut and bolt, etc.) may be utilized instead of the preferred peg and hole arrangement to secure the secondary seats to the primary seat.

In use, when it is desired to provide additional seating, one merely has to retrieve one or both secondary seats 30, 32 from their stowed positions beneath the primary seat 16, unfold legs 34, 36, and insert pegs 38, 40 into mating holes 19.

It is to be understood that the present invention is not limited to the embodiment described above, but encompasses any and all embodiments within the scope of the following claims.

I claim:

1. A modular, multiple-seat chair, comprising:

a main chair having a back, a pair of front legs, and a pair of rear legs;

a primary seat disposed on the main chair, the primary seat having two sides;

a respective ledge positioned adjacent each lateral side of the primary seat, each of the ledges having at least one opening formed vertically therein;

support structure positioned beneath the primary seat; and a pair of secondary seats removably stored on the support structure, wherein each said secondary seat has an undersurface, a first end, and a second end, the modular, at least one peg depending from the undersurface of each said secondary seat adjacent the second end thereof, the respective pegs being slidable into their respective openings in said ledges to removably attach said secondary seats to said primary seat.

2. The modular, multiple-seat chair according to claim 1, further including a respective wheel disposed on each said front leg and each said rear leg.

3. The modular, multiple-seat chair according to claim 1, wherein said pair of front legs is spaced a distance from said pair of rear legs, and wherein said support structure spans the distance between said front legs and rear legs, said support structure being attached to said pair of front legs and said pair of rear legs.

4. The modular, multiple-seat chair according to claim 1, wherein each said secondary seat has an undersurface, a first end, and a second end, the modular, multiple-seat chair further comprising a respective foldable leg pivotally attached to the undersurface of each said secondary seat adjacent the first end thereof.

5. The modular, multiple-seat chair according to claim 1, wherein said primary seat and said pair of secondary seats have upper seating surfaces and wherein said upper seating surfaces are cushioned.

6. A modular, multiple-seat chair, comprising:

a main chair having a back, a pair of front legs, and a pair of rear legs, the pair of front legs being spaced a distance from the pair of rear legs;

a respective wheel disposed on each of the front and rear legs;

a primary seat disposed on the main chair, the primary seat having opposite lateral sides;

a respective ledge positioned adjacent each of the opposing sides of the primary seat, each of the ledges having a respective pair of attachments structures formed vertically therein;

support structure positioned beneath the primary seat, the support structure spanning the distance between the front and rear legs, the support structure being attached to the pair of front legs and the pair of rear legs; and a pair of secondary seats removably stored on the support structure, wherein each secondary seat has an underside, a first end, and a second end, the modular, multiple-seat chair further comprising a pair of respective coupling members depending from the underside of each said secondary seat adjacent the second end thereof, the respective secondary seat coupling members removably mating with the respective ledge attachment structures in each respective said ledge.

7. The modular, multiple-seat chair according to claim 6, wherein each said secondary seat has an underside, a first end, and a second end, the modular, multiple-seat chair further comprising a respective foldable leg pivotally attached to the underside of each said secondary seat adjacent the first end thereof.

8. The modular, multiple-seat chair according to claim 6, wherein said primary seat and said pair of secondary seats have upper seating surfaces, the modular, multiple-seat chair further comprising cushions disposed on the upper seating surfaces of said primary seat and said secondary seats.

9. A modular, multiple-seat chair, comprising:

a main chair having a back, a pair of front legs, and a pair of rear legs, the pair of front legs being spaced a distance from the pair of rear legs;

a respective wheel disposed on each of the front and rear legs;

a primary seat disposed on the main chair, the primary seat having two lateral sides;

a respective ledge positioned adjacent each of the lateral sides of the primary seat, the ledges having a respective pair of openings formed therein;

support structure positioned beneath the primary seat, the support structure spanning the distance between the front and rear legs, the support structure being attached to the pair of front legs and the pair of rear legs;

a pair of secondary seats removably stored on the support structure, each of the secondary seats having an underside, a first end, and a second end;

a respective foldable leg pivotally attached to the underside of each of the secondary seats adjacent the first end thereof; and a pair of respective pegs depending from the undersurface of each secondary seat adjacent the second end thereof, the pegs removably mating with the openings in each of the respective ledges.

10. The modular, multiple-seat chair according to claim 9, wherein said primary seat and said pair of secondary seats have upper seating surfaces, the modular, multiple-seat chair further comprising cushions disposed on the upper seating surfaces of said primary seat and said secondary seats.

* * * * *